US008185004B2

(12) United States Patent
Schwarz-Kock et al.

(10) Patent No.: US 8,185,004 B2
(45) Date of Patent: May 22, 2012

(54) METHOD AND ARRANGEMENT FOR SETTING THE DOT SIZE OF PRINTED IMAGES GENERATED WITH THE AID OF AN ELECTROGRAPHIC PRINTING OR COPYING SYSTEM

(75) Inventors: Thomas Schwarz-Kock, Marzling (DE); Ralph Dorfner, Oberding (DE)

(73) Assignee: Oce Printing Systems GmbH, Poing (DE)

( * ) Notice: Subject to any disclaimer, the term of this patent is extended or adjusted under 35 U.S.C. 154(b) by 429 days.

(21) Appl. No.: 12/517,709

(22) PCT Filed: Dec. 12, 2007

(86) PCT No.: PCT/EP2007/063814

§ 371 (c)(1),
(2), (4) Date: Jun. 4, 2009

(87) PCT Pub. No.: WO2008/071741

PCT Pub. Date: Jun. 19, 2008

(65) Prior Publication Data

US 2010/0028032 A1 Feb. 4, 2010

(30) Foreign Application Priority Data

Dec. 12, 2006 (DE) ..... 10 2006 058 580

(51) Int. Cl.
*G03G 15/00* (2006.01)

(52) U.S. Cl. ..... 399/49

(58) Field of Classification Search ..... 399/16, 399/27–29, 38, 49–51, 53, 265–267, 290, 399/291

See application file for complete search history.

(56) References Cited

U.S. PATENT DOCUMENTS 4,639,117 A 1/1987 Murai et al.

(Continued)

FOREIGN PATENT DOCUMENTS

DE 32 40 943 A1 5/1983

(Continued)

OTHER PUBLICATIONS

Digitaldruck Feb. 2005.

*Primary Examiner* — Hoan Tran
(74) *Attorney, Agent, or Firm* — Schiff Hardin LLP

(57) ABSTRACT

In a method or system to set a dot size of toner images, at least one latent raster image is generated that is not to be inked with toner particles in at least one region to form a first toner image. At least one additional latent raster image is generated that is to be inked with toner particles over its entire surface, the additional latent raster image being inked with toner particles to form an additional toner image. With a sensor unit a first toner particle quantity is determined which is used to ink at least one toner image and a second toner particle quantity is determined which is used to ink the at least one additional toner image. A ratio of the first toner particle quantity and the second toner particle quantity is determined. The determined ratio is used as a measure representing a real value for an areal coverage of the first toner image and the real value is compared with a desired value. An electrical field is set, depending on a result of the comparison, to transfer toner particles to regions of the at least one latent raster image that are to be inked.

11 Claims, 5 Drawing Sheets

U.S. PATENT DOCUMENTS

| | | | |
|---|---|---|---|
| 5,250,988 | A | 10/1993 | Matsuura et al. |
| 5,329,339 | A | 7/1994 | Sakamoto et al. |
| 5,950,042 | A | 9/1999 | Goto et al. |
| 6,034,703 | A | 3/2000 | Broddin et al. |
| 6,081,677 | A | 6/2000 | Maess et al. |
| 6,173,134 | B1 | 1/2001 | Nishimura et al. |
| 7,016,620 | B2 | 3/2006 | Maess et al. |
| 2001/0033755 | A1 | 10/2001 | Ino et al. |
| 2003/0091355 | A1 | 5/2003 | Jeschonek et al. |
| 2005/0286916 | A1 * | 12/2005 | Nakazato et al. ..... 399/16 |

FOREIGN PATENT DOCUMENTS

| | | |
|---|---|---|
| DE | 101 36 259 | 2/2003 |
| EP | 0 535 655 A2 | 4/1993 |
| JP | 05333647 | 12/1993 |
| WO | WO 98/06011 | 2/1998 |

* cited by examiner

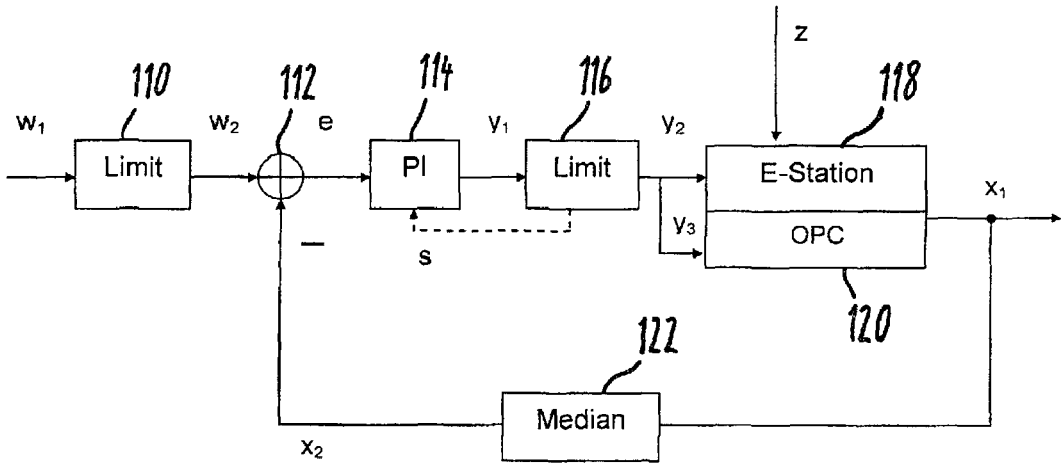

$w_1$ - command variable
$w_2$ - limited desired value
e - regulatory deviation
$y_1$ - unlimited correction variable, development contrast (or $HV_{JumpDC}$)
$y_2$ - limited correction variable, development contrast (or $HV_{JumpDC}$)
$y_3$ - limited correction variable, potential contrast (or charge potential)
s - stop signal for the integrator
$x_1$ - control variable, ratio of the kTMS signals $TM_{Raster}$ / TM for $TM_{Raster}$
$x_2$ - filtered control variable
z - disturbance variables, e.g. areal coverage, mixture aging, TK variations ...

Fig. 4

METHOD AND ARRANGEMENT FOR SETTING THE DOT SIZE OF PRINTED IMAGES GENERATED WITH THE AID OF AN ELECTROGRAPHIC PRINTING OR COPYING SYSTEM

BACKGROUND

The preferred embodiment concerns a method and an arrangement for setting the point (dot) size of printed images generated with the aid of an electrographic printing or copying system in which a latent raster image to be inked with toner particles is generated and is inked with toner particles to form a print image. The preferred embodiment also concerns a computer program product for implementation of the method according to the preferred embodiment, as well as a method to regulate an image generation process of an electrographic printing or copying system, and such a printing or copying system.

To achieve a desired optical appearance of a print image generated with the aid of an electrographic image generation method, it is necessary to set the point (dot) size of raster points inked with toner particles. For example, electrographic image generation methods comprise electrophotographic, magnetographic and ionographic printing methods.

In electrographic image generation methods, the point size can in particular be set via an auxiliary voltage used to ink a latent raster image, which auxiliary voltage serves as a development threshold and is designated as a bias voltage. First a latent raster image is generated on a photoconductor, said latent raster image is inked with toner particles and it is thereby developed. Such a print image is subsequently transfer-printed onto a substrate material (for example paper). A method and a device to control an image generation process of an electrographic image generation device are known from the document DE 101 36 259 A1 and the parallel U.S. Pat. No. 7,016,620 B2. A toner mark inked with toner particles is generated on the intermediate image carrier, wherein the energy with which a character generator acts to generate the toner mark is decreased relative to the energy for the generation of additional print images given otherwise identical image structure. The color density of the toner mark inked with toner particles is determined with the aid of a reflection sensor. The toner concentration in a developer station is determined with the aid of the determined color density.

SUMMARY

It is an object to specify a method and a device via which the point size of print images generated with the aid of an electrographic printing or copying system can be set in a simple manner.

In a method or system to set a dot size of toner images, at least one latent raster image is generated that is not to be inked with toner particles in at least one region to form a first toner image. At least one additional latent raster image is generated that is to be inked with toner particles over its entire surface, the additional latent raster image being inked with toner particles to form an additional toner image. With a sensor unit a first toner particle quantity is determined which is used to ink at least one toner image and a second toner particle quantity is determined which is used to ink the at least one additional toner image. A ratio of the first toner particle quantity and the second toner particle quantity is determined. The determined ratio is used as a measure representing a real value for an areal coverage of the first toner image and the real value is compared with a desired value. An electrical field is set, depending on a result of the comparison, to transfer toner particles to regions of the at least one latent raster image that are to be inked.

BRIEF DESCRIPTION OF THE DRAWINGS

FIG. 4 shows a regulatory loop to regulate the point size of an inked pixel in a print image.

DESCRIPTION OF THE PREFERRED EMBODIMENTS

Figure 1A:
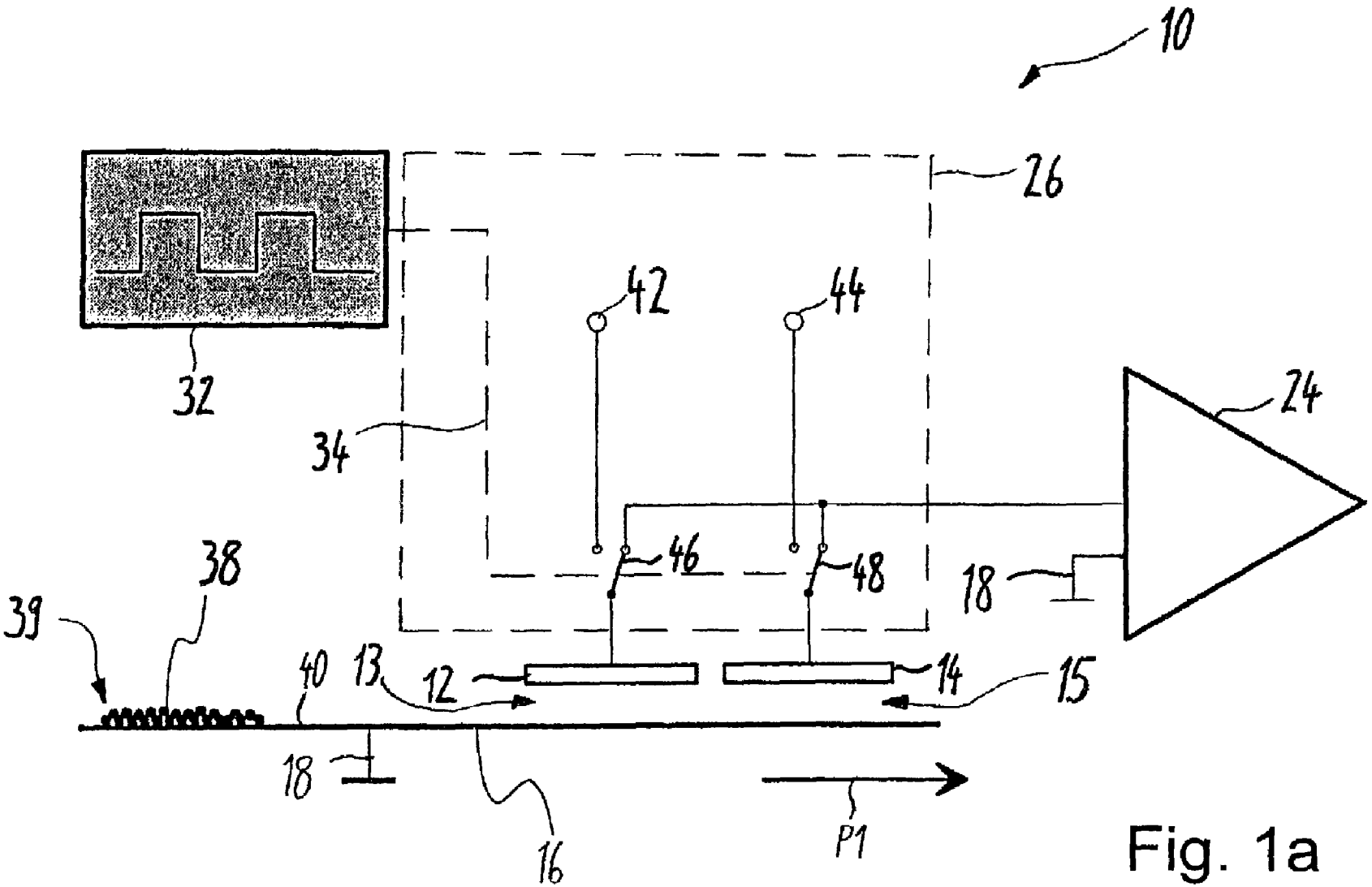
FIG. 1*a* is a schematic representation of the design of a device to determine the areal coverage of a toner mark.

For the purposes of promoting an understanding of the principles of the invention, reference will now be made to the preferred embodiments/best mode illustrated in the drawings and specific language will be used to describe the same. It will nevertheless be understood that no limitation of the scope of the invention is thereby intended, and such alterations and further modifications in the illustrated device and method, and such further applications of the principles of the invention as illustrated as would normally occur to one skilled in the art to which the invention relates are included.

In a method for setting the point (dot) size of print images generated with the aid of an electrographic printing or copying system, at least one latent raster image that is not to be inked with toner particles over its entire surface is generated and inked with toner particles to form a print image. A measure for the surface of the print image that is actually inked with toner particles is also determined and compared as a real value with a desired value. An electrical field to transfer toner particles to the regions of the latent raster image that are to be inked is set depending on the comparison result and used as a default for further print images to be subsequently generated. The auxiliary transfer voltage for transferring toner particles onto a photoconductor is advantageously set, with the aid of which transfer voltage a force in the direction of the regions of the latent raster image that are to be inked and present on the photoconductor is exerted on the toner particles provided by a developer station. The print image is advantageously a toner image.

With this method a point size corresponding to the desired value is thus set via which the actual surface inked with toner particles corresponds to the surface to be inked that corresponds to the desired value. This adaptation of the actual inked surface to the surface to be inked occurs by changing the point size of individual pixels of the print image in that the electrical field for transfer of toner particles onto the regions of the latent raster image that are to be inked is simply set to a value that is required for this. The line width of lines to be printed, in particular of relatively narrow lines to be printed with a line width of one raster point, two raster points or up to ten raster points, can in particular be set via the adaptation of the point size of the inked image pixels, such that an adjustment of the actual and optically perceived width of the printed line is achieved. Such an adjustment or change is also visible in letters in the print image. Given large surfaces that are to be inked with toner over the entire area, the enlargement or reduction of the point size of individual raster points that are to be inked has an effect only in border regions of these surfaces to be inked and produces a change of the print image that is barely optically perceptible. The actual surface of a print image or of a portion of the print image that is inked with toner particles is also designated as areal coverage. The areal coverage indicates the proportion of the printed surface to the total surface. Alternatively, in rater images the areal coverage is also designated as raster tone density or raster tone value. The areal coverage in raster tone images is in particular dependent on the size of the inked region of a pixel, i.e. the point size. With the aid of the method according to the preferred embodiment, the real point size is advantageously set to a desired point size without thereby affecting other image generation parameters.

In one development of the preferred embodiment, the latent raster image has multiple band-shaped regions that are to be inked with toner particles, which band-shaped regions are arranged at intervals relative to one another. These regions are lines arranged in parallel in the print image, whereby in particular the line width of these generated lines can be detected in that a suitable measure for the actual area of the print image that is to be inked with toner particles is determined. The line width of the lines of the print image that is detected in this way is directly proportional to the area of the print image that is actually inked with toner particles. The line width can thus in particular be adjusted by varying the desired value. This adjustment of the line width or the setting of the point size of image points of a print image to be generated can occur in the same manner if the raster image comprises individual raster points to be inked or inked pixels and/or regions that are composed of multiple pixels (for example, 2×2 or 4×4 pixels) to form what are known as superpixels, in addition to or as an alternative to the band-shaped regions to be inked.

It is particularly advantageous to determine the measure for the actual area of the print image that is inked with toner particles in a manner that is independent of the layer thickness. The setting and/or the regulation of the point size can thereby be determined independent of the actual layer thickness of the toner particle layer of the regions of the print image that are inked with toner particles. Errors in the adjustment or regulation of the point size or line width are thereby avoided. One measure for the actual area inked with toner particles can be the toner quantity used to ink at least one region of the print image, and/or the average layer thickness of a toner particle layer of the toner quantity used to ink at least one region of the print image. Alternatively or additionally, the optical density of the surface inked with toner particles can be determined, which optical density can serve as a measure for the area of the print image actually inked with toner particles.

At least one additional latent raster image that is to be inked with toner particles over its entire surface can also be generated. The additional latent raster image is inked with toner particles to form an additional print image. The area of the print image that is inked with toner particles is thereby determined depending on the additional print image. Via the determination of the area of the print image inked with toner particles depending on the additional print image, a determination of the surface of the print image that is inked with toner particles that occurs independent of the layer thickness can also be achieved when the layer thickness, due to the measurement method used, has an effect on the measurement result of a measurement device to determine the measure for the area actually inked with toner particles. Such a measurement device can in particular be a capacitive sensor, for example a capacitive toner mark sensor.

In one development of this advantageous embodiment, the toner particle quantity used to ink the print image is determined in relation to the toner particle quantity used to ink the additional print image. This ratio of the toner particle quantity of the print image and that of the additional print image indicates the ratio of the inked area of the print image and an inking over the entire surface (surface of the additional print image that is inked with toner particles over its entire surface). This ratio can thereby be indicated as a desired value or a default value of an area to be inked can be predetermined as a desired ratio for a tangible raster image to be generated.

The electrical field to transfer toner particles onto the regions of the latent raster image that are to be inked can thereby be set depending on the comparison result so that: the electrical field for the inking of latent raster images with toner particles is increased when the real value is smaller than the desired value; the electrical field for the inking of latent raster images with toner particles is reduced when the real value is greater than the desired value; and the electrical field for the inking of latent raster images with toner particles is maintained when the real value is equal to the desired value. A transfer region is provided between an image medium that has the latent raster image to be inked with toner particles and a transport element to transport toner particles to be provided. In the transfer region, a force in the direction of the regions of the image medium to be inked is exerted on the toner particles present in the transfer region due to the electrical field between the generated surface of the transport element and the regions of the latent raster image present on the image medium and to be inked with toner particles.

In the transfer region, a force in the direction of the generated surface of the transport element is exerted on the toner particles present in the transfer region via the electrical field between the generated surface of the transport element and the regions of the latent raster image that are not to be inked with toner particles. The transport element is advantageously an applicator element on whose generated surface a closed toner particle layer is generated that is transported on this generated surface into the transfer region. Via such an applicator element, a layer made up of toner particles with a constant layer thickness can be generated on the generated surface of the applicator element and provided for inking of the regions of the image medium that are to be inked. This toner layer can in particular be generated by contacting the applicator element with a magnetic brush made up of a two-component mixture made of carrier particles and toner particles). The layer thickness can thereby in particular be affected and adjusted via the auxiliary transfer voltage between a magnet roller with whose help the magnetic brush is generated and the generated surface of the applicator element. Via the auxiliary transfer voltage, an electrical field is generated that exerts a force on the toner particles of the two-component mixture of the magnetic brush in the direction of the applicator element. Alternatively or additionally, the layer thickness can be affected or adjusted via the toner concentration in the two-component mixture.

A raster image that is not to be inked with toner particles over its entire surface can be generated with the aid of the same print data. The raster images to be inked that are generated in such a manner are respectively inked with toner particles to form a print image. The real value of the inked surface is repeatedly determined from these repeatedly generated print images or toner marks inked with toner particles. Each determined real value is compared with the current default desired value, wherein the electrical field to transfer the toner particles to the regions of the latent raster image to be inked is set with the aid of an adjustable auxiliary voltage, depending on the comparison result. The point size of the raster points inked with toner, i.e. of the inked pixels of the print image, is thereby regulated to a point size corresponding to the default desired value. Via this regulation the point size can also be held constant or be brought to a specific value, even given changing conditions in the image generation process. The point size can be changed simply by changing the desired value. The desired value can advantageously be preset with the aid of at least one adjustment parameter via the control panel of the printing or copying system. The adjustment parameter in particular concerns the line width and/or the point size.

The print image, multiple print images, the additional print image and/or multiple additional print images can be generated in parallel or serially on a photoconductor belt, a photoconductor drum, a transfer belt and/or an image medium (advantageously in the form of a toner mark). At least the measurement for the area of the print image or of the print images that are actually inked with toner particles is respectively detected there. The selection of a suitable detection location in the image generation process is thereby possible in a simple manner to determine the actual area of the print image that is inked with toner particles. The image medium is, for example, a single sheet serving as a recording medium or a paper web serving as a recording medium.

A second aspect of the preferred embodiment concerns an arrangement for setting the point size of the print images generated with the aid of an electrographic printing or copying system. The arrangement has an image generation unit that generates at least one raster image that is not to be inked with toner particles over its entire surface, and the image generation unit inks said raster image with toner particles to form a print image. The arrangement also comprises a sensor unit that determines a measure for the area of the print image that is actually to be inked with toner particles and outputs this measure as a real value. The arrangement also has a control unit that compares the determined real value with a desired value, wherein the control unit sets the strength of an electrical field to transfer toner particles onto the regions of the latent raster image that are to be inked depending on the comparison value; the control unit in particular changes the strength of said electrical field given a deviation of the real value from the desired value.

A third aspect of the preferred embodiment concerns a method for regulating an image generation process of an electrographic printing or copying system in which a first potential to which a photoconductor of the printing or copying system is charged is regulated. A second potential to which the regions of the photoconductor are discharged is also regulated. Furthermore, the layer thickness of a toner particle layer as well as the point size of raster points inked with toner particles in a print image to be generated are regulated.

Four parameters that are decisive for the image generation are advantageously regulated independent of one another via this method. A suitable desired value to which the actual value of the respective parameter can then be regulated can thereby be preset for every regulation.

In one development of the method, the toner particle layer is generated on the generated surface of a transport element for inking of charged or discharged regions of the photoconductor. The layer thickness can thereby in particular be set and regulated independent of the point size.

A fourth aspect of the preferred embodiment concerns an electrographic printing or copying system that has a control unit that has a first regulator for charging a photoconductor to a preset first potential; that has a second regulator for discharging regions of a photoconductor to a preset second potential; that has a third regulator to generate a toner particle layer with a preset layer thickness; and that has a fourth regulator to regulate the point size of raster points (i.e. pixels) inked with toner particles in a print image to be generated. In these electrographic printing or copying systems, the parameters that are important for the image generation process of the electrographic printing or copying system (charge potential, discharge potential, layer thickness of the toner particle layer and point size of the pixels inked with toner particles) can be regulated (advantageously independent of one another) so that print images can be generated at a high quality with a desired, adjustable point size.

For a better understanding of the present invention, in the following reference is made to the preferred exemplary embodiments shown in the drawings, which preferred exemplary embodiments are described using specific terminology. However, it is noted that the protective scope of the invention should not thereby be limited since such variations and additional modifications to the shown devices and/or the described methods, as well as such further applications of the invention as they are shown therein, are viewed as typical present or future expertise of a competent man skilled in the art. The drawing figures show exemplary embodiments of the invention, namely:

A measurement arrangement 10 to detect a toner mark 39 generated as a toner particle layer 38 with the aid of an electrographic image generation process is shown in FIG. 1*a*. This measurement arrangement 10 is used in an electrographic printer or copier according to the preferred embodiment to detect the areal coverage of the toner mark 39 forming the toner layer 38, and therefore the point size of raster points inked with toner particles. The average layer thickness of the toner mark 39 present in the detection region of this measurement arrangement 10 is detected with the aid of the measurement arrangement 10.

The toner mark 39 exhibits a homogeneous print image with a uniform inking pattern with an inking over the entire surface, or with an inking that is not over the entire surface. The toner layer 38 of the toner mark 39 has been generated as a latent raster image in the form of a charge image on a photoconductor belt 16 charged with the aid of a charging device (for example a corotron device) with the aid of a character generator (for example an LED character generator or a laser character generator). This latent raster image has subsequently been developed with the aid of a developer unit (not shown) in that the toner particles provided by the developer unit have been used to ink the latent raster image.

The development of the latent raster image with toner particles advantageously occurs with the aid of what is known as tribo-jump development, in which electrically charged toner particles provided by the developer unit are transferred from the developer unit to regions to be inked due to the force exerted on them by an electrical field in the direction of the regions of the latent raster image that are to be inked. The voltage required to generate the electrical field is also designated as a bias voltage. It is particularly advantageous when a layer of toner particles is provided with an essentially constant layer thickness by the developer station, which layer thickness is then transferred via the bias voltage only to the regions to be inked.

An additional electrical field that exerts a force on the toner particles in the direction of the developer station so that no toner particles are transferred from the developer station to the regions of the photoconductor belt 16 that are not to be inked is generated by the bias voltage between the regions of the latent raster image that are not to be inked and the developer station. A schematic of a tribo-jump developer station is shown and briefly described by way of example on Page 222 in FIG. 8.22 in the document "Digital Printing—Technology and Printing Technics [sic] of Océ Digital Printing Presses", $9^{th}$ edition, February 2005; ISBN 3-00-001081-5.

The photoconductor belt 16 is a revolving continuous belt that is directed with the aid of deflection rollers (not shown). The photoconductor belt 16 contains electrically conductive components that are connected in an electrically conductive manner with a reference potential 18. The toner layer 38 of the generated toner marks 39 as well as toner layers of print images are arranged on the generated surface 40 of the photoconductor belt 16. A first electrode 12 and a second electrode 14 (which in the exemplary embodiment are designed as plate-shaped electrodes 12, 14) are arranged parallel to the generated surface 40. The active areas of the electrodes 12, 14 and the photoconductor belt 16 serving as a counter-electrode are facing one another, wherein the first and the second electrodes 12 and 14 advantageously exhibit the same active area. Relative to the electrodes 12, 14, the photoconductor belt 16 is thus a counter-electrode connected with the reference potential 18. The first electrode 12 and the counter-electrode form a first capacitor 13, and the second electrode 14 and the counter-electrode form a second capacitor 15. Given the same active area of the electrodes 12, 14 and an identical distance of the electrodes 12, 14 from the counter-electrode, the first capacitor 13 and the second capacitor 15 have the same capacitance if no toner layer 38 and no toner residues or the same toner quantity are present between the photoconductor belt 16 and the electrodes. The distance between photoconductor belt 16 and the electrodes 12, 14 is preset to a value in the range from 0.2 to 10 mm. This distance is advantageously approximately 1 mm.

A switching unit 26 is provided in order, in a first switching state, to connect the electrode 12 with a voltage source 42 that is positive relative to the reference potential 18 and the electrode 14 with a voltage source 44 that is negative relative to the reference potential 18; the switching occurring with the aid of crossover switches 46, 48. The magnitudes of the voltages provided by the voltage sources are advantageously equal. For example, the positive voltage output by the voltage source 42 is +10 V, for example, and the negative voltage output by the voltage source 44 is −10 V, for example, relative to the reference potential 18 (0 V, for example).

In a second switching state, with the aid of the crossover switches 46, 48, the switching unit 26 separates the connections to the voltage sources 42, 44, shorts the two electrodes 12, 14 and thereby establishes a connection to the evaluation unit 24. The charge difference of the capacitors 13, 15 is thus determined and supplied to the evaluation unit 24. A sampling of a measurement value generated by the charge difference occurs by switching over into the second switching state. A clock signal 34 of a clock signal emitter 32, which signal 34 is advantageously a square wave signal with constant pulse-pause ratio, is supplied to the switching unit 26. The clock frequency of the clock signal 34, and thus the switching frequency of the switching unit 26 for switching over the two switching states or the crossover switches 46, 48 advantageously lies in a range between 300 Hz and 1 MHz.

The clock pulse emitter 32 is in particular a component of the control unit to evaluate the sensor signal output by the measurement arrangement 10, wherein the clock signal 34 produces a change of the switching state of the crossover switches 46, 48 in the switching unit. The switching of the capacitors as a result of the switching states is also designated as a switched capacitor technique. Additional details regarding the design and additional embodiments of the measurement arrangement 10 are known from the document DE 101 51 703 A1 as well as the parallel U.S. Pat. No. 6,771,913 B2, the content of which is herewith incorporated by reference into the present specification.

The evaluation unit 24 can, for example, have a filter and a downstream amplifier. A measurement signal generated by the evaluation unit 24 is supplied to a control unit (not shown) for additional processing. If, as already mentioned, a filter is used for evaluation in the evaluation unit 24, the filter type as well as the required filter parameter of the filter are preset depending on the switching frequency and the resulting sampling frequency.

If the toner particle layer 38 of the toner mark 39 is transported through the air gaps of the electrodes 12/16 and 14/16 onto the photoconductor belt 16 in the direction of arrow P1, the capacitance difference of the two capacitors 13, 15 is determined at each sampling point in time or at each crossover switching point in time in the two operating states. The capacitances of the capacitors 13, 15, which are identical without toner marks in the detection region of the measurement arrangement 10, change when toner particles are present in the region between the respective electrode 12, 14 and the counter-electrode since the toner particles have a different permittivity than the air that is otherwise exclusively present between the electrodes 12/16, 14/16.

The layer thickness of the toner particle layer that would be present given a uniform distribution of the toner particles present in the respective capacitor 13, 15 on the active surface of the respective capacitor 13, 15 can be determined from the change of the capacitance of at least one of the capacitors 13, 15. The average layer thickness of the toner particles present in the detection region of the respective capacitor 13, 15 is thus determined since a toner mark 39 that covers half of the active area of a capacitor 13, 15 and does not exhibit a first layer thickness cannot be differentiated from a second toner mark 39 that covers the entire active area of the capacitor 13, and has half of the layer thickness of the first layer thickness.

However, using the capacitance curve the exact layer thickness curve of a toner mark in the transport direction of the photoconductor belt 16 can also be determined given correspondingly complicated evaluation and a sufficient number of samples relative to the transport speed to transport the photoconductor belt 16 in the direction of arrow P1.

The capacitance change of the capacitors 13, 15 as a result of the toner particles of the toner layer 38 that are present on the photoconductor belt 16 in the region of the capacitors 13, 15 results from the change of the dielectric, i.e. from the change of the layered dielectric of the respective capacitor 13, 15 given transport of the toner layer 38 between the respective electrode 12, 14 and the counter-electrode of the respective capacitor 13, 15.

The charge difference generated at the sampling point in time by the short circuiting of the electrodes 12, 14 in the second switching state depending on the capacitances of the capacitors 13, 15 is additionally processed with the aid of the evaluation circuit 24 and advantageously supplied to the control unit. According to the preferred embodiment, given a known layer thickness the control unit can also determine the areal coverage of the respective toner mark 39 when the print image of the respective toner mark 39 is not completely inked with toner particles. In particular given toner marks 39 with multiple band- or line-shaped regions of a print image arranged in parallel and inked with toner particles, the area of the toner mark 39 that is inked with toner particles and/or the area of the toner mark 39 that is not inked with toner particles in the region of a respective capacitor 13, 15 can be determined or identified with aid of the capacitor 13, 15 given constant, known layer thickness. Given toner marks inked with toner particles over their entire surface, the layer thickness of the toner particle layer (and thereby the optical density of the toner mark) can be determined or identified. In the same way, the inked area of the toner mark 39 can be determined when the toner mark 39 additionally or alternatively has regions inked in dots. These regions inked in dots can comprise both individual pixels and regions composed of multiple pixels (what are known as superpixels).

It is advantageous to supply a toner mark inked over its entire surface and a toner mark that is not inked over its entire surface to the arrangement 10 in an arbitrary order whose regions to be inked are respectively inked with the same layer thickness, whereby the ratio of the toner quantity of the toner mark that is not inked over its entire surface can be determined depending on the toner quantity of the toner mark that is inked over its entire surface. The relative inking or the percentile area of the partially inked toner mark can thereby be determined relative to the toner mark inked over its entire surface.

Figure 1B:
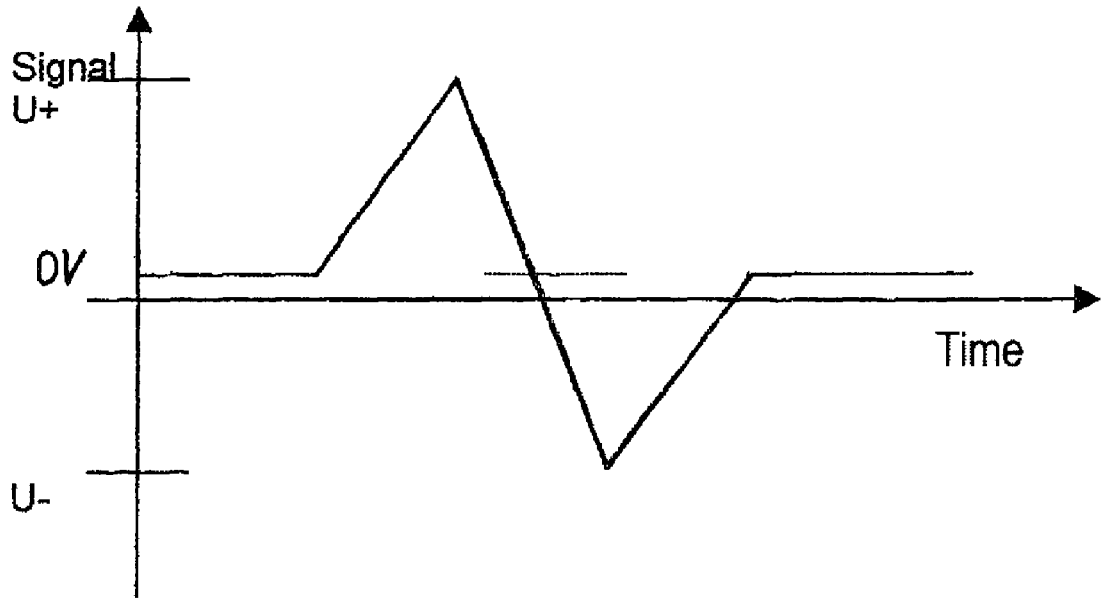
FIG. 1*b* shows a voltage-time diagram with the principle curve of a measurement signal generated by the device according to FIG. 1*a* to implement a toner mark.

A time-voltage diagram in which the principle signal curve of a measurement signal output by the measurement arrangement according to FIG. 1*a* is shown is presented in FIG. 1*b*. For simplification, a continuous signal curve is presented in the time-voltage diagram according to FIG. 1*b*. However, the actual signal curve is composed of a plurality of sample values. The sampling rate to determine these sample values is determined by the clock signal 34 output by the clock pulse emitter 32. The signal curve is sampled with the aid of the evaluation arrangement 24 upon direction of the toner mark 39 through the capacitors 13, 15 when the photoconductor belt 16 is directed with a constant speed (for example in a range from 0.2 to 2 m/s) through the capacitors 13, 15, between the electrodes 12, 14 and the photoconductor belt 16.

The permittivity of toner is greater than the permittivity of air. The capacitance of the capacitors 13, 15 upon direction of the toner mark 39 through these capacitors 13, 15 is thereby changed. With the aid of the photoconductor belt 16, the toner layer 38 of the toner mark 39 is transported into the first capacitor 13. The capacitance of the first capacitor 13 is thereby increased. The capacitance of the first capacitor 13 thereby increases until the toner layer 38 of the toner mark 39 covers the greatest possible active area of the first capacitor 13. The signal shown in FIG. 1 thereby increases with rising capacitance of the first capacitor 13 from 0 V up to a maximum U+. Due to the continuous driving of the photoconductor belt 16, the toner layer 38 of the toner mark 39 is further transported into the second capacitor 15 and simultaneously is transported out of the first capacitor 13. The capacitance of the second capacitor 15 thereby increases to the same degree as the capacitance of the first capacitor 13 decreases. The negative slope of the output signal of the evaluation arrangement 24 is thereby approximately twice as great as given mere conveyance of the toner layer 38 of the toner mark 39 out of the first capacitor 13 or given conveyance of the toner layer 39 of the toner mark 39 into the second capacitor 15.

If the toner layer 38 has been entirely transported out of the first capacitor 13, and this toner layer 38 covers the greatest possible active area of the second capacitor 15, the evaluation arrangement 24 outputs a voltage signal U−. The toner layer 38 is subsequently transported out of the second capacitor 15, whereby the voltage signal output by the evaluation arrangement 24 rises from value U− to 0. This rise occurs up to the point in time at which the toner layer 38 has been transported out of the second capacitor 15.

Given toner marks that are not entirely inked, for example that exhibit multiple band-shaped inked regions that are arranged in parallel, the average layer thickness of the toner mark 39 that would be generated given a uniform distribution of the toner particle quantity used to ink the toner images that are not completely inked can be determined with the aid of the measurement arrangement 10. With the aid of the measurement arrangement 10, a step-by-step capacitance change as a result of the inked and un-inked regions of a toner mark is possible at least with greater effort if band-shaped, inked regions of the toner mark 39 are aligned transverse to the transport direction P1 of the photoconductor belt. Alternatively or additionally, the toner mark that is not completely inked over its entire area can comprise regions inked in dots that consist of one pixel, or in which a region inked in dots comprises multiple pixels that form what is known as a superpixel. The superpixel comprises 2×2, 2×3 or 4×4 pixels, for example.

The average inking of a toner mark or a measurement signal that corresponds to the average layer thickness of a toner mark that is not inked over its entire surface can be simply determined with the aid of the measurement arrangement 10. If the layer thickness with which the toner image that is not inked over its entire surface is additionally known, the areal coverage of this toner mark that is not inked over its entire surface can be determined in a simple manner based on the determined average layer thickness of the toner mark that is not inked over its entire surface.

The layer thickness can additionally be determined (in particular measured) in various ways. A toner mark inked over its entire surface is advantageously detected with the aid of the arrangement according to FIG. 1*a*, wherein the different change of the capacitances of the capacitors 13, 15 due to the toner mark that is inked over its entire surface and due to the toner mark that is not inked over its entire surface indicates the areal coverage of the toner mark that is not inked over its entire surface. This is possible in that the inked regions of the toner mark that is inked over its entire surface and the toner mark that is not inked over its entire surface exhibit the same layer thickness of the toner particle layer used for inking.

Figure 2:
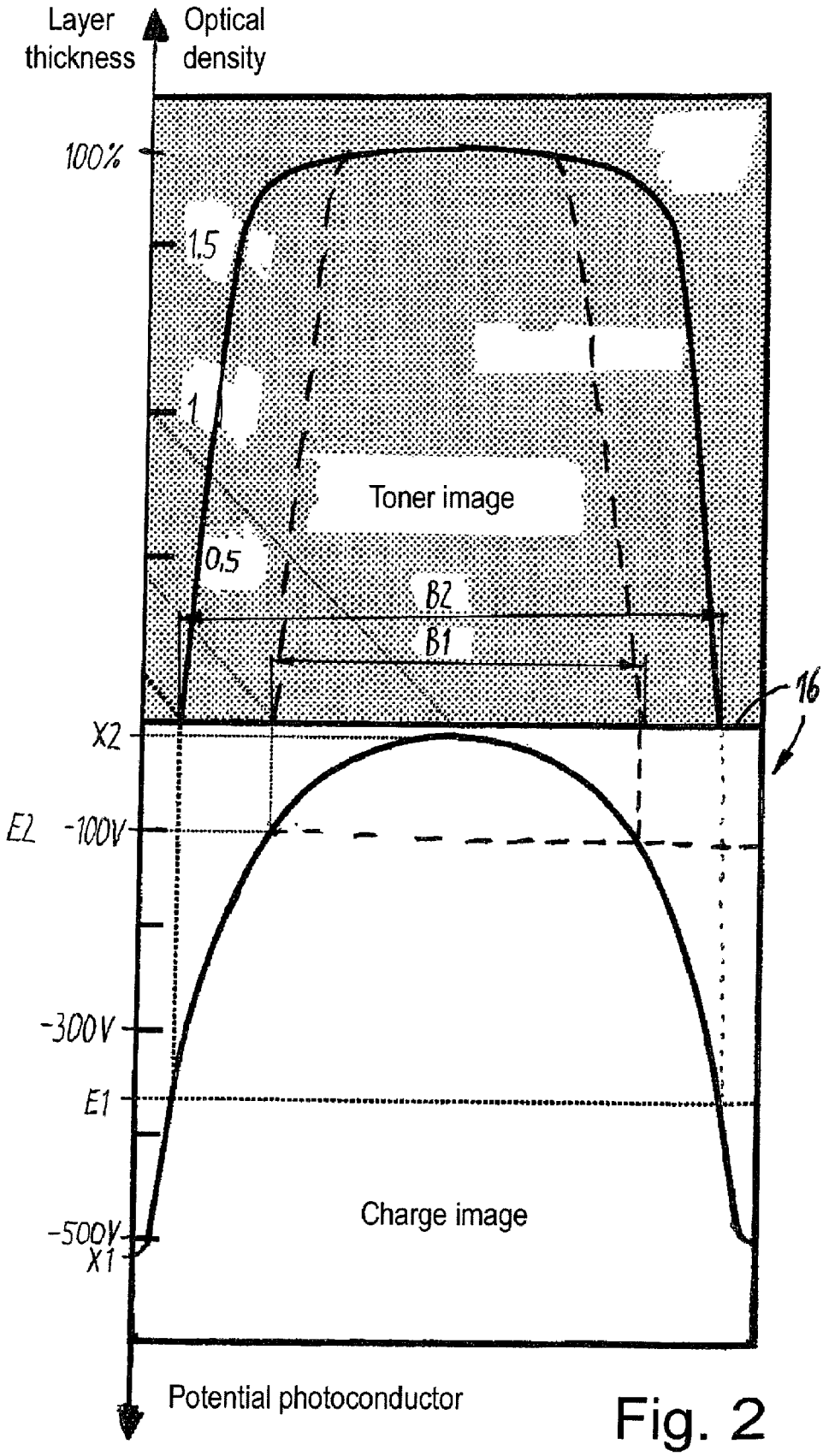
FIG. 2 shows a diagram with a charge distribution and a toner particle distribution generated due to the charge image over the cross section of a discharged raster point of a photoconductor.

FIG. 2 shows a diagram in which are shown the charge distribution of a latent raster image in a raster point to be inked with toner particles and a section through the toner particle layer generated based on the charge distribution at the raster point. The charge distribution of a raster image to be inked is shown in the lower half of the presented diagram over the cross section of the raster point. The photoconductor belt 16 has been negatively charged to a potential X1 of −518 V with the aid of the aforementioned charge unit. The photoconductor belt 16 has subsequently been exposed with light energy at the shown raster point so that it has been discharged to a potential X2 of −27 V relative to a reference potential (for example the ground potential [sic] in the center of the raster point. A change of the potential of the photoconductor 16 to −518 V from a higher potential is also designated as a charging of the photoconductor in the present application. The supply of charge carriers in order to produce a change of the potential at the raster point from −518 V to −27 V is furthermore also designated as a discharge in the present application.

The potential drops towards the charge potential X1 of −518 V from the center of the discharged raster point to the photoconductor belt 16, whereby the shown potential curve of the charge image through the cross section of the raster point on the photoconductor belt 16 has a shape in the manner of a Gaussian curve. A development threshold is set via the level of the applied bias voltage for the transfer of toner particles from the developer station to the regions of the photoconductor belt 16 that are to be inked, i.e. onto the raster point shown in FIG. 2.

The development thresholds E1 and E2 are additionally shown in FIG. 2. Only the regions of the photoconductor belt 16 that lie below the respective development threshold E1, E2 set with the aid of the bias voltage are inked with toner particles since a force only in the direction of the regions of the photoconductor belt 16 that are discharged below the respective development threshold E1, E2 is exerted on the electrically charged toner particles provided by the developer station. Due to this force the electrically charged toner particles are deposited on the surface of the photoconductor belt 16 as a toner particle layer (i.e. are transferred onto the surface of the photoconductor belt 16) and are thereby developed.

A dot-like region on the surface of the photoconductor belt 16 whose size is dependent on the potential curve of the charge image of the photoconductor belt 16 at the raster point and on the potential of the development threshold E1, E2 results due to the respective development threshold E1, E2. A section of the region to be inked with toner with a width B1 in the shown section results for the development threshold E1, and a section of the region to be inked with toner with a width B2 in the shown section results for the development threshold E2.

In the upper region of the diagram according to FIG. 2, a cross section of the raster point inked with toner particles is shown as a solid line for the development threshold E1 and as a dashed line for the development threshold E2. A frustum-shaped deposit of toner particles on the photoconductor belt 16 at the shown raster point results for an individual inked raster point. The layer thickness of the deposited toner particle layer on the raster point is respectively 100% in the center of the raster point, wherein the width of the inked region on the generated surface of the photoconductor belt 16 is established by the width B1, B2 established by the section line of the respective development threshold E1, E2. Given a preset development threshold E2 in the shown exemplary embodiment, the point size is thereby approximately 68% of the point size given a preset development threshold E1. The point size can thus be set in a simple manner via a variation of the development threshold E1, E2. The optical density of the toner particle layer generated at the raster point also increases with the layer thickness.

Figure 3:
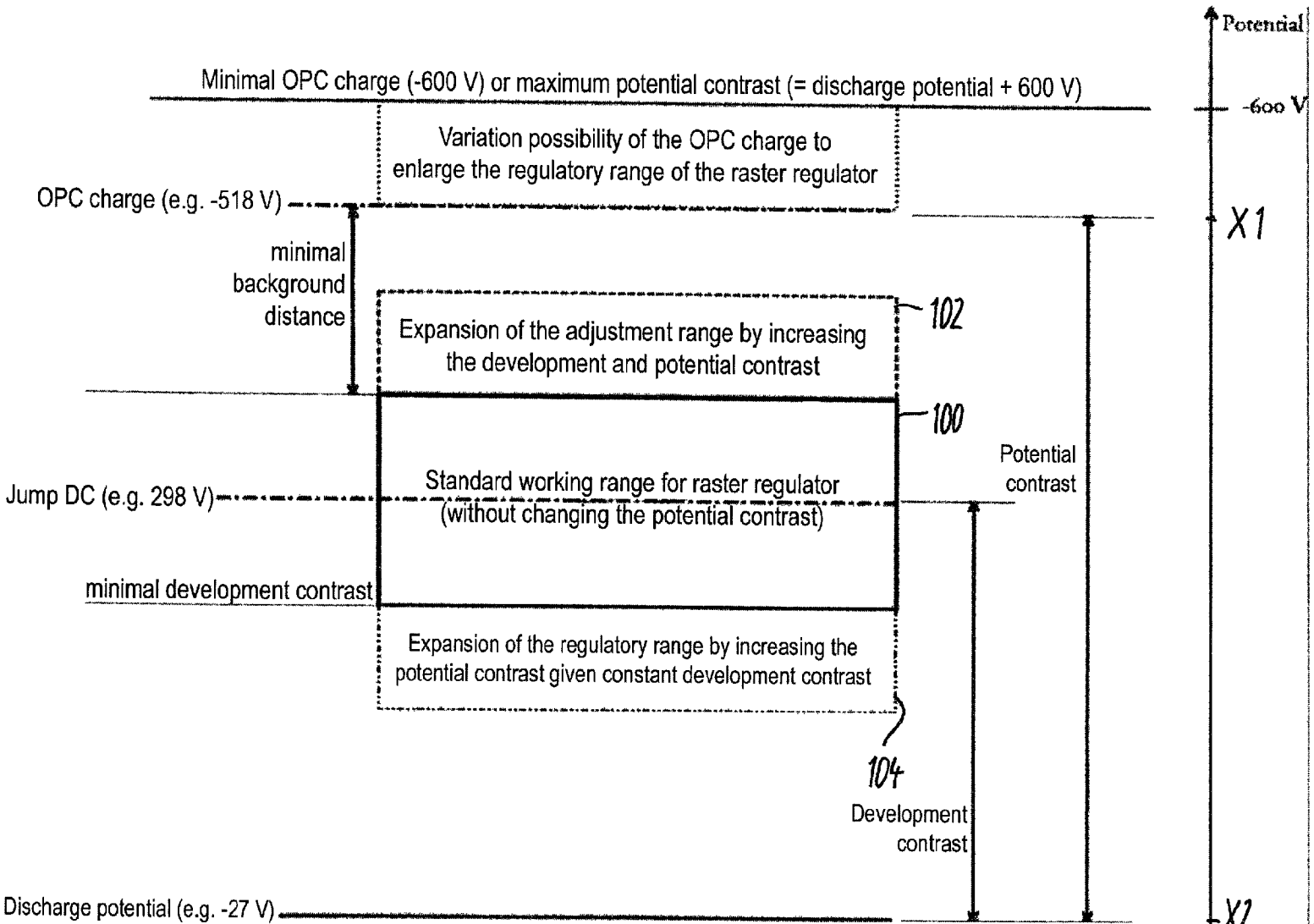
FIG. 3 illustrates a scale with possible potentials of the surface of the photoconductor in an electrographic image generation process.

A scale with potentials of the photoconductor belt 16 and the development voltage (bias voltage or jump DC) is shown in FIG. 3, wherein a possible working range of the auxiliary development voltage is designated with the reference character 100. As already explained in connection with FIG. 2, the photoconductor belt 16 is charged to a potential X1 of −518 V relative to a reference potential of the printing or copying system of 0 V. In regions of individual raster points that are to be inked with toner particles, the photoconductor belt 16 is discharged to a discharge potential of −27 V. For this concrete exemplary embodiment, the center of the possible working range of the auxiliary development voltage (bias voltage) lies at −298 V DC.

At the upper end of the negative charge potential of −518 V DC, the working range 100 is defined by a minimal background interval that is required so that a sufficient force is exerted on the electrically charged toner particles in the direction of the developer station or away from the surface of the photoconductor belt 16 in regions of the print image that are not to be inked with toner particles. Unintended deposits of toner particles on regions that are not to be inked are thereby effectively prevented. Such deposits are also designated as a background of a toner or print image.

A potential difference is absolutely necessary between the discharge potential of −27 V DC and the lower limit of the possible range for the auxiliary transfer voltage in order to exert the force on the toner particles provided by the developer station that is necessary to transfer the electrically charged toner particles from the developer station onto the photoconductor belt 16 across an air gap provided between the developer station and the photoconductor belt 16.

The working range 100 around the ranges 102 and 104 can be enlarged by increasing the potential difference of the charged photoconductor belt 16 to a potential of, for example, −600 V relative to the reference potential, whereby a greater variation of the size of the region of the raster point that is inked with toner is possible. The bias voltage can thereby be varied in a total working range composed of the working ranges 100, 102, 104 in order to set the point size, i.e. the area of the/a raster point to be inked.

It is advantageous to regulate the adjustment of the point (dot) size with the aid of a regulatory loop. One exemplary embodiment of such a regulatory loop is shown in FIG. 4. A desired value w1 is thereby predetermined as a command variable, for example via a presetting via a control panel of the printing or copying system. This desired value w1 is supplied to a limiter 110 that outputs a limited desired value w2. A respective real value x1 is also determined from multiple successively generated print images that are not inked over their entire surface. The ratio of the signals of a toner mark 39 that is not inked with toner particles over its entire surface and of a toner mark inked with toner particles over its entire surface (which signals are determined with the aid of the measurement device of the arrangement according to FIG. 1*a*) is repeatedly determined. Alternatively, the absolute value for a toner image of a toner mark 39 that is not inked over its entire surface can be repeatedly determined.

The repeatedly detected real values 1 of the controlled variable are supplied to a median filter 122 that outputs the median of these real values x1 as a filtered controlled variable x2 that is subtracted from the desired value w2 in point 112, wherein a regulatory deviation e is determined and supplied to a P1 regulator 114. Depending on the regulatory deviation e, the PI regulator 114 outputs an unlimited correcting variable y1 of the development contrast, i.e. a correcting variable to adjust the bias voltage. This correcting variable y1 is supplied to a limiter 116 that outputs to the developer station 118 a limited correcting variable y2 to set the bias voltage or the development contrast, and outputs to the charging unit 120 for charging the photoconductor belt 16 a limited correcting variable y3 to set the potential contrast. The difference between charging potential and discharging potential of the photoconductor belt 16 is designated as a potential contrast. The limiter 16 also outputs a stop signal S that is output to the PI regulator 114 upon exceeding the limit value.

Various factors affecting the image generation process affect the controlled system as disturbance variables z, for example the total areal coverage of print images, the mixture age, toner concentration variations in the developer station, aging of the photoconductor belt 16 etc. In spite of these disturbance variables, via the regulatory loop according to FIG. 4 the point size of inked pixels can be kept constant corresponding to the preset desired value (w2). As an alternative to the regulatory loop shown in FIG. 4, regulatory loops without median filter 112 and/or without limiter 110, 112 can also be used. Only one correcting variable y1 can also be provided to adjust the bias voltage.

Via the preferred embodiment it is possible to implement a charge regulation, a discharge regulation, an inking regulation and a point size regulation simultaneously and independently of one another in an electrographic printing or copying system. Given charge regulation, the current charge is determined via the measurement of the surface potential with the aid of a potential probe, and if necessary the charge is brought or held to a preset desired value via variation of the corona current of a charge corotron for charging the photoconductor. Influences of temperature fluctuations, aging of the photoconductor and of the charge corotrons as well as tolerance deviations in the manufacture of photoconductors can thereby be largely eliminated. Given discharge regulation, the discharge potential can be determined with the same potential sensor used for the charge regulation, and if necessary the light energy of the character generator can be adjusted or varied. The discharge potential is also designated as a contrast potential. In inking regulation, the toner resupply into the developer station is adjusted so that a predetermined inking is achieved depending on a default value (light, normal, dark etc.). In known printers, toner marks that are inked over their entire surfaces are typically used as toner marks for the inking regulation. For a point size regulation according to the preferred embodiment, it is not toner marks that are inked over their entire surface that are used, wherein toner marks inked over their entire surface that are additionally generated can be used for the inking regulation.

Via the regulation of the point size, the line width of lines to be generated and the line width of print elements to be generated (for example letters) can in particular also be set, whereby a desired optical impression of the elements to be shown can be generated in a simple manner. With the aid of the arrangement 10 according to FIG. 1*a*, the degree of inking of a toner image or of a toner mark can be determined in a simple manner. Given suitable print data to generate the latent raster image, the point size or the line width in the print image of the toner mark that is not inked over its entire surface can therefore be determined in a simple manner.

As an alternative to the arrangement according to FIG. 1*a*, an optical measurement can also be used that in particular is also based on the different reflection properties of the inked and un-inked regions of the toner mark. A capacitive sensor with only one capacitor 13, 15 can also be used. Additionally or alternatively, the degree of inking of the toner mark that is not inked over its entire surface can be determined via the toner quantities used for inking when the toner quantities used for inking or, for example, the toner quantity remaining on the surface of an applicator element of the developer station are detected. The toner mark that is not inked over its entire surface is also designated as a raster toner mark since this raster toner mark exhibits raster points that are not inked with toner particles or regions that are not inked with toner particles.

The continuous regulation of the point size is particularly advantageously dependent on a preset desired value. For this, at least the toner marks that are not inked over their entire surface are repeatedly generated, whereby the correcting signals are adjusted as necessary depending on the regulatory deviation. The image generation process of the printing or copying system can thereby be additionally stabilized. The regions of the toner marks/print images that are inked with toner can be detected both on a photoconductor (photoconductor belt 16 or, respectively, photoconductor drum), on an additional intermediate image carrier (for example a transfer belt) or on a substrate material to be printed.

The toner mark that is not inked over its entire surface can advantageously exhibit multiple lines arranged next to one another (in particular in parallel) that are inked with toner particles and whose areal coverage given normal inking, cover, for example, approximately 40% of the total area of the toner mark with toner particles. If the desired value is increased, for example in that expanded line width is preset via a graphical slider or another input possibility, the desired value can be increased to 45%, for example, or be decreased to 35% given a reduction of the line width. The point size is thereupon increased or reduced via the regulator shown in FIG. 4 so that the toner marks then subsequently generated exhibit an areal coverage corresponding to the desired value.

A step regulation is also advantageous in which, in addition to the bias voltage, the charging voltage to charge the photoconductor can be varied since the adjustment range of the point size can thereby be further increased, as shown by the expanded working ranges 102, 104 in FIG. 3. The desired value for adjustment of the charging voltage can thereby be increased not only from −518 V DC to −600 V DC in the present exemplary embodiment.

If additional toner marks that are inked over their entire surface are generated, these can in particular also be used to set or to regulate the toner concentration in the developer station. Alternatively or additionally, these toner marks can be used to adjust the layer thickness of a toner particle layer in the developer station on the generated surface of an applicator element. As an alternative to the Pi regulator 114, other typical regulators (in particular P, PD, PID regulators or multipoint regulators) can also be used.

The preferred embodiment can advantageously be used in electrographic printing or copying apparatuses whose recording methods for image generation are in particular based on the electrophotographic, magnetographic or ionographic recording principle. The printing or copying apparatuses can also use a recording method for image generation in which an image recording medium is directly or indirectly electrically energized, point-by-point.

Although preferred exemplary embodiments have been displayed and described in detail in the drawings and in the preceding specification, they should be viewed as purely exemplary and not as limiting the invention. It is noted that only the preferred exemplary embodiments are shown and described, and all variations and modifications that presently and in the future lie within the protective scope of the invention should be protected.

We claim as our invention:

1. A method to set a dot size of toner images generated with aid of an electrographic printing or copying system, comprising the steps of:

generating at least one latent raster image that is not to be inked with toner particles in at least one region, said at least one latent raster image to be inked in other regions with toner particles to form a first toner image;

generating at least one additional latent raster image that is to be inked with toner particles over its entire surface, said additional latent raster image being inked with toner particles to form an additional toner image;

determining a first toner particle quantity that is used to ink the at least one toner image and a second toner particle quantity used to ink the at least one additional toner image with aid of a sensor unit;

determining a ratio of the first toner particle quantity and the second toner particle quantity;

using the determined ratio as a measure representing a real value for an areal coverage of the first toner image and comparing the real value with a desired value; and setting an electrical field to transfer toner particles to said regions of the at least one latent raster image that are to be inked depending on a result of the comparison.

2. The method according to claim 1 wherein the at least one latent raster image that is not to be inked with toner particles in at least one region has at least one of the regions to be inked selected from the group multiple band-shaped regions that are to be inked with toner particles and dot-shaped regions to be inked with toner particles, said band-shaped or dot-shaped regions being arranged at an interval from one another.

3. The method according to claim 1 wherein the areal coverage of the first toner image that is inked with toner particles is determined in a manner that is independent of at least one of layer thickness or independent of toner concentration in a developer mixture made up of toner particles and carrier particles for inking at least one latent raster image with toner particles.

4. The method according to claim 1 wherein the areal coverage is determined as a measure for an actual area of the first toner image that is inked with toner particles, and said areal coverage is compared as said real value with said desired value specifying a desired areal coverage.

5. The method according to claim 1 wherein the determined ratio indicates a ratio of an inked area of the toner image and an inked area of the additional toner image.

6. The method according to claim 1 wherein the electrical field to ink the at least one latent raster image with toner particles is increased when the real value is smaller than the desired value, the electrical field for the inking of the at least one latent raster image with toner particles is reduced when the real value is greater than the desired value, and the electrical field for the inking of the at least one latent raster image with toner particles is maintained when the real value is equal to the desired value, a transfer region is provided between an image medium that has the at least one latent raster image to be inked with toner particles and a generated surface of a transport element to transport toner particles, in the transfer region, a force in a direction of the regions of the image medium to be inked is exerted on the toner particles present in the transfer region due to the electrical field between the generated surface of the transport element and regions of the latent raster image to be inked with toner particles, and the transport element comprises an applicator element, and on the generated surface of the element a closed toner particle layer is generated that is transported into the transfer region.

7. The method according to claim 1 wherein a dot of a raster point that is inked with toner particles in the toner images to be generated with aid of the printing or copying system is set by changing the electrical field.

8. The method according to claim 7 wherein the at least one latent raster image that is not to be inked in at least one region is respectively generated repeatedly with aid of same print data and is inked with toner particles to form said first toner image, the real value of the inked surface of the first toner image so generated is repeatedly determined, every determined real value is compared with the desired value, and the electrical field is set depending on the comparison result, and a dot size of raster points inked with toner is regulated to a dot size corresponding to said preset desired value.

9. The method according to claim 1 wherein the desired value is preset via a setting parameter on a control panel of the printing or copying system, the setting parameter comprising at least one of a line width and a dot size.

10. The method according to claim 1 wherein the at least one additional raster image is generated on at least one of a photoconductor belt, a photoconductor drum, a transfer belt, and a printing substrate in the form of a toner mark.

11. A system for setting dot size of toner images generated with aid of an electrographic printing or copying system, comprising:

an image generation unit that generates at least one latent raster image that is not to be inked with toner particles in at least one region, said image generation unit inking said at least one latent raster image with toner particles in other regions to form a first toner image, and said image generation unit also generates at least one additional latent raster image that is to be inked with toner particles over its entire surface, and said image generation unit inking said additional latent raster image with toner particles to form an additional toner image;

a sensor unit that determines a first toner particle quantity used to ink the first toner image and a second toner particle quantity used to ink the additional toner image;

a control unit that determines a ratio of the first toner particle quantity and the second toner particle quantity, the determined ratio being used as a measure representing a real value for an areal coverage of the first toner image, and the control unit comparing the real value with a desired value; and the control unit setting a strength of an electrical field to transfer toner particles to said regions of the at least one latent raster image that are to be inked depending on a value of the comparison.

* * * * *